US005545068A

United States Patent [19]

Asbaghi

[11] Patent Number: 5,545,068

[45] Date of Patent: Aug. 13, 1996

[54] PROPELLER LAUNCHING TOY

[75] Inventor: Ahmed A. Asbaghi, Hawthorne, Calif.

[73] Assignee: Mattel, Inc., El Segundo, Calif.

[21] Appl. No.: 515,722

[22] Filed: Aug. 15, 1995

[51] Int. Cl.[6] ..... A63H 27/127

[52] U.S. Cl. ..... 446/39; 446/260

[58] Field of Search ..... 446/37–41, 43–45, 446/145, 260; 124/31, 16

[56] References Cited

U.S. PATENT DOCUMENTS

| | | | |
|---|---|---|---|
| 688,762 | 12/1901 | Weber | 446/39 |
| 880,633 | 3/1908 | Curtis . | |
| 1,294,917 | 2/1919 | Koontz | 446/39 |
| 1,462,221 | 7/1923 | Wolfe | 446/39 |
| 1,873,896 | 8/1932 | Krastin | 446/39 |
| 2,921,404 | 1/1960 | Lescher . | |
| 3,570,467 | 3/1971 | Belokin, Jr. | 446/39 X |
| 5,030,157 | 7/1991 | Silverglate | 446/48 |

*Primary Examiner*—Mickey Yu
*Attorney, Agent, or Firm*—Roy A. Ekstrand

[57] ABSTRACT

A propeller launching toy includes a pistol-shaped housing having a movable trigger and a rotatable winding collar. A main shaft is rotatably supported within the housing and is operatively coupled to the winding collar. A main spring is coupled to the main shaft to provide stored energy for rotating the main shaft. A propeller toy having a plurality of propeller blades is releasably secured to the forward end of the main shaft. A ratchet mechanism is coupled to the winding mechanism to provide single direction motion of the winding collar and main shaft. The trigger is coupled to a pivotable lever which responds to trigger movement to release the engagement of the main shaft and allow rapid spinning of the main shaft which in turn spins the propeller toy. As the propeller toy is rapidly spun, the propeller blades provide aerodynamic lift launching the propeller toy.

6 Claims, 2 Drawing Sheets

10
11
12
13
14
16
17
20
21
22
30
31
32
33
34
35
36
40
41
2
1
71
72
73
80
81
82
83
84
85
86
87
88
89
92
93
94
95
96
97
98
99
107
108
112
113
114
115

PROPELLER LAUNCHING TOY

FIELD OF THE INVENTION

This invention relates generally to aerial toys and particularly to those launching a spinning propeller-like flying object.

BACKGROUND OF THE INVENTION

Aerial toys which utilize flying objects in various shapes and configurations are extremely popular with young children. The variety of such toys is virtually endless and has included flying toys such as miniature airplanes, gliders, various projectiles such as simulated rockets, as well as a variety of toys generally referred to as spinner-type flying toys. The latter are particularly popular due to the variety of play activities which they employ. While the shapes and configurations of such spinner-type flying toys has been subjected to substantial variation, most generally provide a center hub which supports a plurality of radially extending propeller-like blades. In many cases, the outer tips of the propeller-like blades are joined to an annular outer ring. Such spinner-type flying toys have been known generally in the art as helicopter toys or whirligigs.

The variation of spinner-type flying toys has been equally matched by variations in the devices used to launch the spinner toy. Basically, all provide the same function of imparting a rapid rotation to the spinner-type toy and relying upon the propulsion force provided by the propeller-like blades to induce flight of the spinner-type toy.

For example, U.S. Pat. No. 1,294,917 issued to Koontz sets forth a WHIRLIGIG PISTOL having pistol-shaped housing supporting an elongated rod extending outwardly through the barrel end and terminating in a propeller engaging bit. The remaining end of the rod extends beyond the pistol housing and terminates in a handle. A coil spring encircles the rod within the pistol housing barrel and is fixed to a stationary attachment at one end and to the rotatable rod at the remaining end. A wind-up and ratchet mechanism is coupled to a trigger release to facilitate the storing of torsional energy within the spring which may be released when the trigger is pulled. A propeller-like spinning toy is received upon the forward end and engages the bit. When the spring is wound and the trigger is released, rapid rotation of the spinner-type toy is produced causing its flight.

U.S. Pat. No. 1,873,896 issued to Krastin sets forth a HELICOPTER TOY DEVICE having a pistol grip handle supporting a cylindrical housing. A cylindrical barrel extends forwardly from the cylindrical housing and receives a rotatable shaft extending therethrough. The forwardmost end of the shaft includes a propeller engaging bit. A coil spring is wound about the rotatable shaft and a one-way ratchet drive is coupled between the rotatable shaft and the cylindrical housing. A trigger mechanism is supported within the housing and is coupled to the rotatable shaft. The shaft is wound against the ratchet mechanism to store energy in the spring which is released to launch the propeller toy.

U.S. Pat. No. 3,570,467 issued to Belokin, Jr. sets forth a BIRD LAUNCHER having an elongated housing supporting a spring actuated rotary shaft with means for axially engaging a recessed hub of a target. A release mechanism launches the target by rapidly spinning it. The target includes a plurality of fins or blades to produce aerodynamic lift and launch the target when spun.

U.S. Pat. No. 5,030,157 issued to Silverglate sets forth a FLYING TOY HAVING FLUID DISPLACEABLE BLADES for use in short indoor or outdoor flight games. The flying toy includes a low mass resilient peripheral tension ring, a lightweight flight surface and an inner ring. The flight toy may be maintained in flight by repeated tangential strikes to impart additional rotational and translational speed to the toy.

U.S. Pat. No. 688,762 issued to Weber sets forth a TOY having a hand grip housing supporting a rotatable shaft and a propeller engaging hub. The shaft is coupled to a wind-up spring which facilitates torsional energy within the spring. The hub receives a propeller in releasible attachment and a trigger mechanism is operative upon the hub to facilitate release of the torsional spring energy and launching of the aerial toy.

U.S. Pat. No. 2,921,404 issued to Lescher sets forth an AERIAL SPINNING TOY having an elongated wing, a first counter weight toward one end of the wing and a second counter weight forward of the aerodynamic center of the wing. At least one stabilizing fin is positioned substantially normal to the plane of the wing between the aerodynamic center of the wing and the center of gravity of the toy combination.

While the foregoing described prior art devices have improved the art and, in some instances, enjoyed commercial success, there remains nonetheless a continuing need in the art for evermore improved and amusing propeller launching toys.

SUMMARY OF THE INVENTION

Accordingly, it is a general object of the present invention to provide an improved propeller launching toy. It is a more particular object of the present invention to provide an improved propeller launching toy with an easily manipulated winding mechanism and a reliable safe trigger release mechanism. It is a still more particular object of the present invention to provide an improved propeller launching toy which readily supports a plurality of propeller toys in a convenient and interesting attachment to the launching toy.

In accordance with the present invention, there is provided a propeller launching toy comprising: a housing; a trigger movable supported by the housing; a main shaft supported within the housing and having a forward end extending from the housing and interior end, the main shaft being both rotatably and slidably supported by the housing; a main spring coupled to the main shaft to be wound when the main shaft is rotated in a first rotational direction and unwound when the main shaft is rotated in an opposite second rotational direction; a propeller toy having a center portion engageable with the forward end of the main shaft and a plurality of radially extending propeller blades; a winding collar rotatably supported upon the housing; a ratchet collar coupled to and rotatable with the winding collar having a plurality of first engagement members; a disk joined to the main shaft having a plurality of second engaging members; and a trigger spring coupled to the main shaft urging the mainshaft slidably toward a position in which the first and second engaging members engage; ratchet means coupled to the ratchet collar preventing rotation of the ratchet collar in the second rotational direction; and release means responsive to movement of the trigger to overcome the urging of the trigger spring and moving the main shaft toward a position in which the first and second engaging members disengage thereby allowing the main spring to rotate the mainshaft and the propeller toy.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 4:
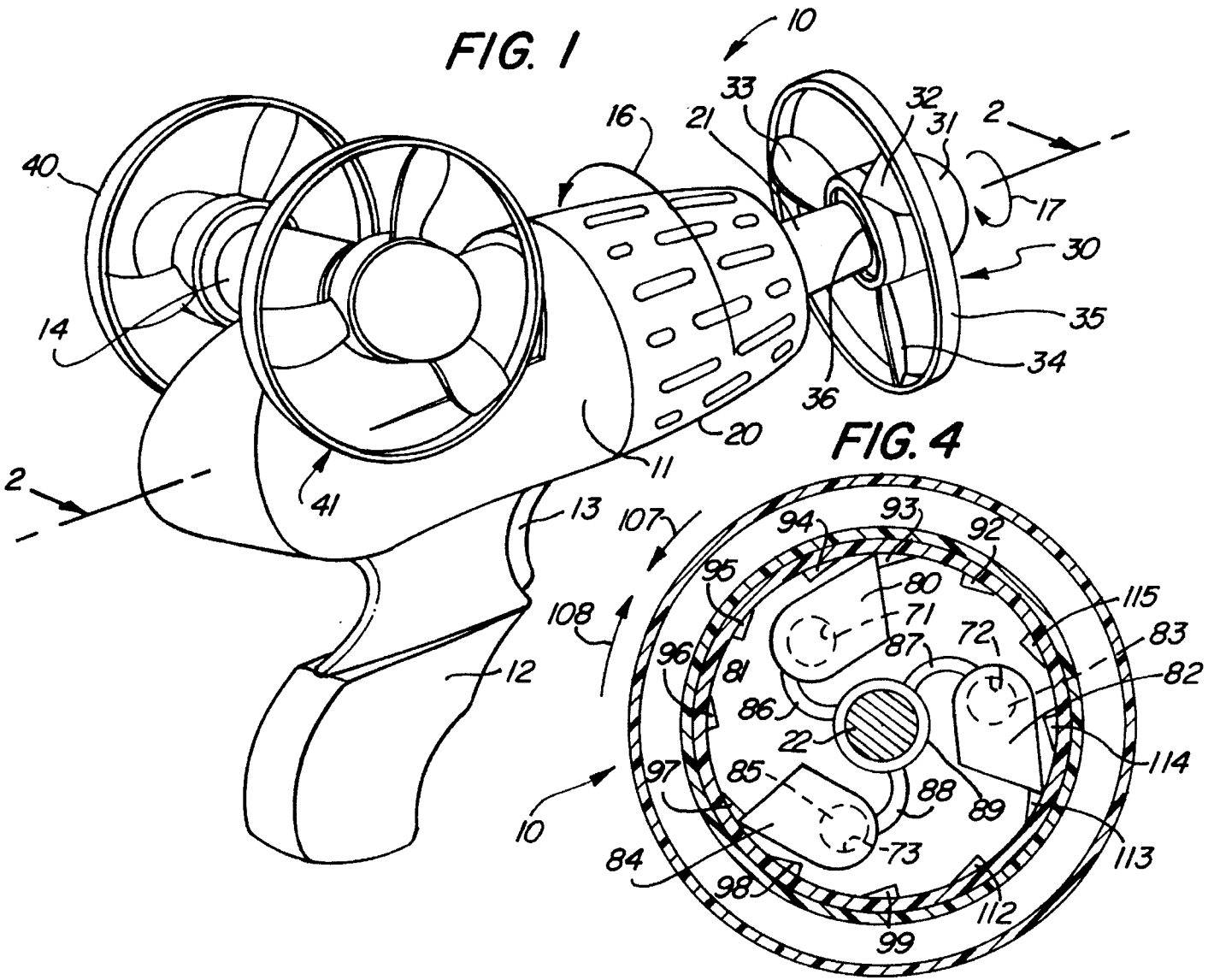
FIG. 1 sets forth a perspective view of a propeller launching toy constructed in accordance with the present invention.
FIG. 4 sets forth a partial section view of the wind-up ratchet mechanism of the present invention propeller launching toy.

FIG. 1 sets forth a perspective view of a propeller launching toy constructed in accordance with the present invention and generally referenced by numeral 10. Toy 10 includes a housing 11 generally configured to correspond in shape to a pistol or hand gun configuration. Accordingly, housing 11 defines a downwardly extending pistol grip handle 12 supporting a movable trigger 13 by means set forth below in greater detail. A winding collar is rotatably supported upon the barrel portion of housing 11 by means set forth below in greater detail. Winding collar 20 further defines a forwardly extending generally cylindrical sleeve 21. Housing 11 further defines a transversely extending generally cylindrical support member 14 which as is better seen in FIG. 2 supports a transversely extending cylindrical shaft 15. A propeller toy 30 includes a center hub 31 defining a recess 36 and a plurality of radially extending propeller blades 32, 33 and 34. An annular outer ring 35 is joined to the outer tips of blades 32 through 34. By means set forth below in FIG. 2 in greater detail, hub 31 further includes a generally cylindrical shaft receptacle 37 which is received within sleeve 21 in a snap-fit attachment. An additional pair of propeller toys 40 and 41 substantially identical to propeller toy 30 are received upon support shaft 15 (seen in FIG. 2) to conveniently carry additional propeller toys supported upon housing 11 of toy 10.

In operation, the user places propeller toy 30 upon the forward portion of sleeve 21 in the manner set forth below in greater detail. An internal spring drive mechanism also shown below in greater detail is automatically coupled to propeller toy 30. Thereafter, the user rotates winding collar 20 in the direction indicated by arrow 16 to wind the internal spring drive mechanism and store torsional energy within an internally supported main spring. In further accordance with the present invention and as is set forth below in FIG. 4 in greater detail, a single direction drive ratchet mechanism operatively couples winding collar 20 to the spring drive within housing 11 to facilitate the winding operation. Thus, winding collar 20 need not be continuously rotated upon housing 11 but rather may be repeatedly rotated in the direction of arrow 16 to store energy within the spring through a convenient angular increment and thereafter ratcheted back in the opposite direction to once again be wound in the direction indicated by arrow 16. Following a succession of winding strokes or turns upon collar 20, a substantial energy is stored within the spring drive mechanism supported within housing 11. Thereafter, by means set forth below in greater detail, the user squeezes trigger 13 to release the stored energy within the torsional main spring causing propeller toy 30 to be simultaneously thrust from sleeve 21 and rapidly rotated in the direction indicated by arrow 17. Thereafter, propeller toy 30 continues to rotate due to its mass and the momentum stored therein and begins flying due to the aerodynamic effect of propeller blades 32 through 34. The user may then select an additional propeller toy from propeller toys 40 or 41 and fit it upon the forward portion of sleeve 21 and once again using winding collar 20 rewind the launching mechanism within housing 11 and again press trigger 13 to launch the next propeller toy.

Figure 2:
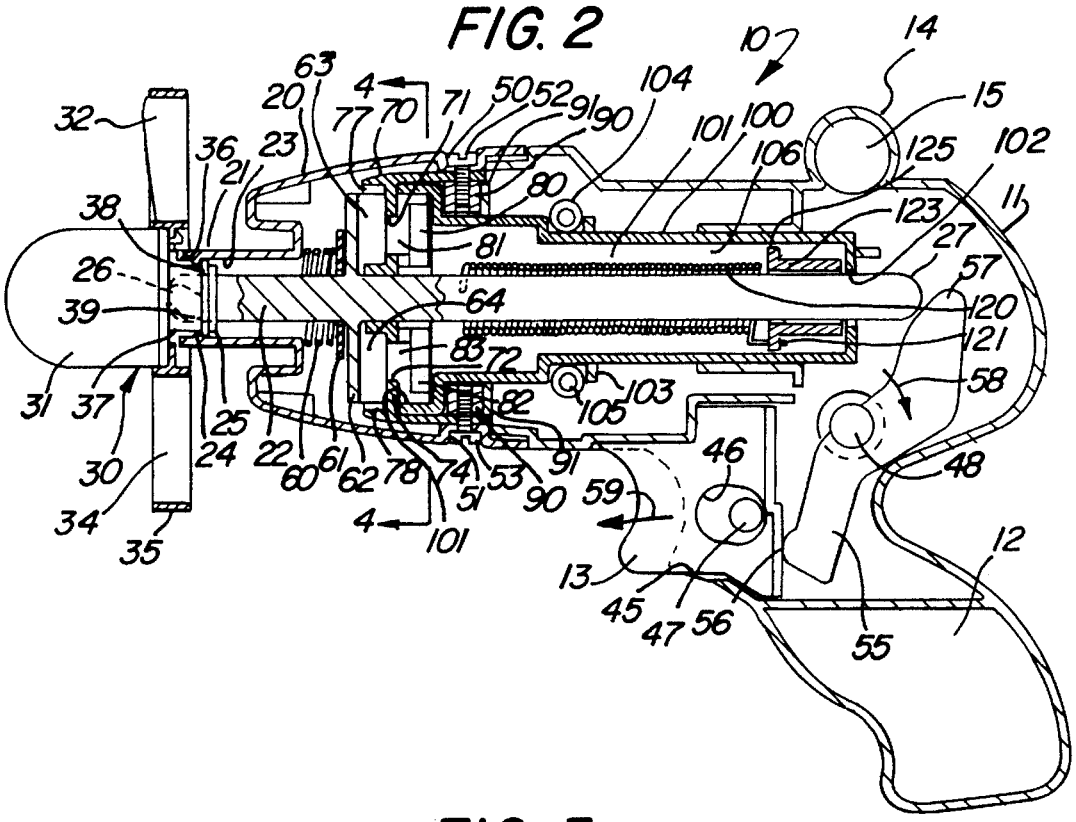
FIG. 2 sets forth a section view of the present invention propeller launching toy taken along section lines 2—2 in FIG. 1 prior to trigger release.

FIG. 2 sets forth a section view of propeller launching toy 10 taken along section lines 2—2 in FIG. 2. As described above, toy 10 includes a generally pistol-shaped housing 11 having a handle 12 and a support member 14. Support member 14 in turn receives a generally cylindrical support shaft 15 which as is described above is used to support additional propeller toys such as propeller toys 40 and 41. An elongated spring housing 100 includes a noncircular portion defining an interior passage 106 and an aperture 102. Spring housing 100 is supported within the interior of housing 11 by a plurality of conventional attachments such as posts 104 and 105 within the interior of housing 11. An outwardly extending rib 103 is formed on the exterior of spring housing 100 which cooperates with posts 104 and 105 to secure the position of spring housing 100. Additional securing members are provided within the interior of housing 11 which are not shown to avoid unduly cluttering the drawing but which should be understood to be in accordance with conventional fabrication techniques. Spring housing 100 is secured at a fixed position within housing 11 and further defines a generally cylindrical ratchet barrel 110 at the forwardmost end thereof. Ratchet barrel 110 is circular in cross-section and is substantially larger than the noncircular portion received posts 104 and 105 and defining passage 106. As is better seen in FIG. 4, ratchet barrel 110 further defines a plurality of angled ratchet teeth 92 through 99 and 112 through 115. Ratchet barrel 110 forms an outwardly extending portion which receives an annular ring 90. A rib 91 is supported within housing 11 and spaced from ratchet barrel 110 to captivate annular ring 90 in a rotatable attachment upon spring housing 100.

A generally cylindrical ratchet collar 70 is received upon ring 90 and secured thereto by a plurality of conventional fasteners such as fasteners 52 and 53. Thus, ratchet collar 70 and ring 90 are rotatably secured to spring housing 100 and maintained at the position shown in FIG. 2. Ratchet collar 70 further includes a center aperture 75 and a generally planar wall 74. Wall 74 defines a plurality of apertures 71, 72 and 73 (the latter seen in FIG. 4) equally spaced upon wall 74. A ratchet pawl 80 includes a cylindrical post 81 received within aperture 71 of ratchet collar 70. A ratchet pawl 82 defines a cylindrical post 83 received within aperture 72 of ratchet collar 70. As is better seen in FIG. 4, a third ratchet pawl 84 defines a post 85 which is received within aperture 73 of ratchet collar 70. Thus, a trio of ratchet pawls are pivotally secured to ratchet collar 70 and rotatable therewith. As is described in detail in conjunction with FIG. 4 below, ratchet pawls 80, 82 and 84 cooperate with the angled teeth formed within ratchet barrel 110 to provide a single direction ratcheting action between ratchet barrel 110 and ratchet collar 70. Ratchet collar 70 further defines a plurality of radially extending ribs such as ribs 77 and 78. A winding collar 20 defines a plurality of apertures such as apertures 50 and 51 which receive fasteners 52 and 53 to secure winding collar 20 to ratchet collar 70. Winding collar 20 generally encloses ratchet collar 70 and ratchet barrel 110 as well as ring 90 and further defines a forwardly extending generally cylindrical sleeve 21 defining an interior passage 23 therein. Sleeve 21 further defines an inwardly extending rib 24. In accordance with the operation of the present invention propeller launching toy, the combined structure formed by winding collar 20, ratchet collar 70, and ring 90 together with ratchet pawls 80, 82 and 84 (the latter seen in FIG. 4) are rotatably supported upon spring housing 100 and rotatable with respect to spring housing 100 and housing 11. Conversely, spring housing 100 including ratchet barrel 110 are maintained in fixed attachment within housing 11. Thus, rotation of the combined structure of winding collar 20, ratchet collar 70, ring 90 and ratchet pawls 80, 82 and 84 with respect to housing 11 produces a corresponding rotational motion with respect to spring housing 100.

Propeller launching toy 10 further includes an elongated cylindrical main shaft 22 having an interior end 27 extending through aperture 102 in spring housing 100. Main shaft 22 further defines an outwardly extending rib 25 and a keyway end 26 at the forward end of main shaft 22. Main shaft 22 further supports a circular disk 62 having a plurality of generally planar radially extending blades such as blades 63 and 64. An annular washer 61 is received upon main shaft 11 and a coil spring 60 is captivated between washer 61 and the interior end of sleeve 21. A main spring 120 is coiled upon main shaft 22 and defines a forward end 122 which is secured to main shaft 22 and a rearward end 121. A spring anchor 123 is slidably supported upon main shaft 22 and is movable within passage 106 of spring housing 100. It should be recalled that passage 106 of spring housing 100 is noncircular in cross-section. Accordingly, spring anchor 123 defines a noncircular outer flange 125 which conforms generally to passage 106. The result is that spring anchor 123 which receives end 121 of main spring 120 is slidably movable upon main shaft 22 but precluded from rotational motion by flange 125 within passage 106. This allows spring anchor 123 to move as main spring 122 is coiled and uncoiled.

Propeller toy 30 includes a center hub 31 supporting a plurality of radially extending propeller blades such as blades 32 and 34. An outer ring 35 is secured to the outer tips of the propeller blades as shown for blades 32 and 34. Hub 31 further defines a generally cylindrical shaft receptacle 37 having an outwardly extending rib 38 formed thereon. Shaft receptacle 37 further defines a keyed recess 39 which receives keyway end 26 of main shaft 22 in a coupling engagement which facilitates engagement between main shaft 22 and shaft receptacle 37 while allowing propeller toy 30 to be free to move away from main shaft 22 once propeller toy 30 is rapidly rotated. While the structure of keyway 26 and recess 39 may be carried forward using a variety of conventional keyed attachments, in its preferred form, keyway 26 and recess 39 defining cooperating helical engagement grooves and splines. It will be recognized by those skilled in the art, however, that other conventional attachments may be utilized without departing from the spirit and scope of the present invention. In the position shown in FIG. 2, propeller toy 30 is forced upon sleeve 21 such that rib 38 of shaft receptacle 37 is forced passed rib 24 of sleeve 21. To facilitate this snap-fit engagement, sleeve 21 is preferably fabricated of a somewhat resilient plastic material or the like. The snap-fit engagement of shaft receptacle 37 within sleeve 21 provided by ribs 38 and 24 maintains propeller toy 10 in engagement with main shaft 22 until dislodged by the trigger release operation set forth below in FIG. 3.

Housing 11 further defines an aperture 45 and a post 47 which receive a trigger 13 in a sliding attachment. Thus, trigger 13 is movable within aperture 45 of housing 11 in a limited travel determined by the size of aperture 56 in trigger 13. Housing 11 further defines a post 48 which receives an elongated trigger arm 55. Arm 55 has an end 56 which contacts the interior edge of trigger 13 and an end 57 which contacts end 27 of main shaft 22. In the position shown in FIG. 2, spring 60 provides sufficient force against washer 61 and disk 62 to force end 27 of main shaft 22 against end 57 of arm 55. As a result, arm 55 is pivoted in the direction indicated by arrow 58 forcing end 56 against trigger 13 which in turn urges trigger 13 outwardly in the direction indicated by arrow 59.

In operation, with propeller launching toy 10 in the configuration shown in FIG. 2, a propeller toy 30 is snap-fitted to sleeve 21 and thus engages the forward end of main shaft 22. In addition, trigger 13 remains in the non-release position allowing spring 60 to force main shaft 22 into housing 11 bringing blades 63 and 64 into engagement with ribs 77 and 78 of ratchet collar 70. The engagement of blades 63 and 64 with ribs 77 and 78 couples main shaft 22 to ratchet collar 70. As is better seen in FIG. 4, ratchet collar 70 is prevented from rotating with respect to spring housing 100 by the action of ratchet pawls 80, 82 and 84 against the angled teeth of ratchet barrel 110. As is also described below in FIG. 4 in greater detail, the action of ratchet pawls 80, 82 and 84 within ratchet barrel 110 facilitate rotation of winding collar 20 and ratchet collar 70 in the wind-up direction while preventing rotation in the unwinding direction with respect to main spring 120. Thus, the user stores energy within main spring 120 by rotating collar 20 in a series of back and forth angular movements to progressively wind main spring 120 upon main shaft 22 storing energy within the main spring. Once the winding action is completed, the user releases winding collar 20 and the action of ratchet pawls 80, 82 and 84 prevents unwinding of main spring 120. At this point, toy 10 is fully prepared for launch of propeller toy 30 and launch may then be achieved by simply pressing trigger 13.

Figure 3:
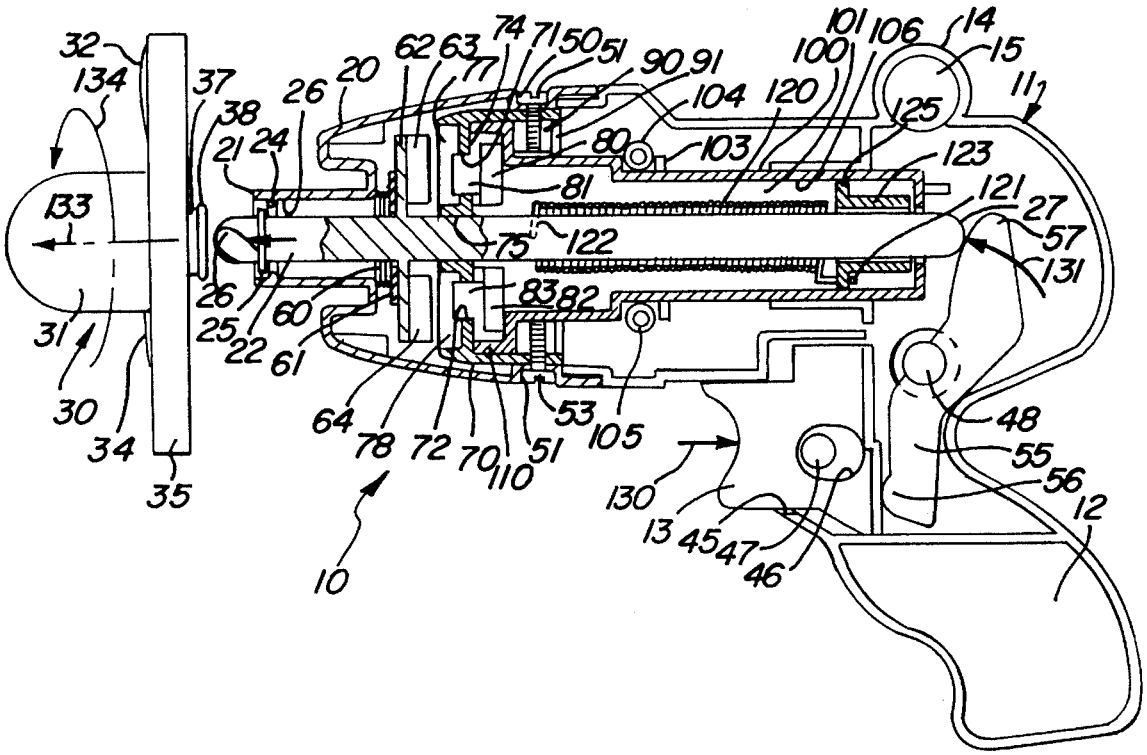
FIG. 3 sets forth a section view of the present invention propeller launching toy taken along section lines 2—2 in FIG. 1 in the trigger release configuration.

FIG. 3 sets forth the section view of FIG. 2 showing propeller launching toy 10 responding to the action of trigger 13 as the user squeezes the trigger and launches propeller toy 30. Thus, as described above, housing 11 supports spring housing 100 in a fixed attachment within housing 11 using posts 104 and 105 together with rib 103. As is also described above, additional support members are provided within housing 11 which are not shown in FIG. 3 to further support spring housing 100 in a fixed stationery position. A main shaft 22 is rotatably supported within spring housing 100 by a spring anchor 123 and an aperture 75 formed within a ratchet collar 70. Ratchet collar 70 supports a plurality of ratchet pawls 80, 82 and 84 and includes a plurality of ribs such as ribs 77 and 78. Winding collar 20 is secured to ratchet collar 70 by a plurality of fasteners such as fasteners 51 and 53 and is further secured to an annular ring 90. Annular ring 90 is maintained in rotatable support upon spring housing 100 by a rib 91 formed within the interior of housing 11. Main shaft 22 includes a keyway end 26 having a rib 25 defined thereon. Correspondingly, winding collar 20 includes a cylindrical sleeve 21 defining a passage 26 therein which in turn defines an inwardly extending rib 24. A disk 62 supporting a plurality of blades such as blades 63 and 64 is formed upon main shaft 22 and captivates a spring 60 and washer 61 between sleeve 21 and disk 62. Spring housing 100 defines a ratchet barrel 110 which as is seen in FIG. 4 defines a plurality of angled teeth which cooperate with pawls 80, 82 and 84 to provide ratcheting action as described below. A main spring 120 is wound upon shaft 22 and includes a fixed end 122 secured to shaft 22 and an end 121 secured to spring anchor 123. A trigger arm 55 is pivotally supported upon a post 48 and defines ends 56 and 57. A trigger 13 is received within an aperture 45 and is slidably captivated upon a post 47 by an aperture 46. A support member 14 defines a support shaft 15 which as is seen in FIG. 1 supports a pair of additional propeller toys 40 and 41 for convenient carrying. Propeller toy 30 includes a center hub 31, a shaft receptacle 37 having a rib 38 formed thereon and a plurality of propeller blades 32 and 34. An annular ring 35 is joined to the outer tips of blades 32, 33 and 34 (blade 33 seen in FIG. 1).

In the release operation once toy 10 has been configured in the manner shown in FIG. 2 and winding collar 20 has been used to store substantial torsional energy within main spring 120, the user presses trigger 13 in the direction indicated by arrow 130. The pressure upon trigger 13 forces end 56 of arm 55 causing end 57 to pivot in the direction indicated by arrow 131 against end 27 of main shaft 22. This overcomes the force of spring 60 compressing spring 60 and moving main shaft 22 in the direction indicated by arrow 132. The engagement of rib 24 within sleeve 21 and rib 38 of shaft receptacle 37 briefly resists the force of trigger 13 against arm 55. However, as the user continues to depress trigger 13, the resistance of ribs 24 and 38 is overcome and main shaft 22 is forced outwardly to the position shown in FIG. 3. As main shaft 22 moves outwardly, disk 62 is moved away from engaging ratchet collar 70 as blades 62 and 64 are removed from contact with blades 77 and 78 of ratchet collar 70. It should be recalled that the engagement of the blades upon disk 62 with the ribs on ratchet collar 70 provides the resisting force together with the ratcheting action of ratchet pawls 80, 82 and 84 (seen in FIG. 4) which prevents main spring 120 from unwinding until trigger 13 is pressed. However, as main shaft 22 continues to move in the direction of arrow 132, the blades of disk 62 are disengaged from the ribs of ratchet collar 70 leaving main shaft 22 free to rotate rapidly in response to the torsional force applied by wound spring 120. As shaft 22 rotates rapidly in the direction indicated by arrow 134, the propeller blades upon propeller toy 30 begin generating aerodynamic lift drawing propeller toy 30 in the direction indicated by arrow 133. As the aerodynamic lift created by the rotation of propeller toy 30 continues to increase and as the rotation of main shaft 22 begins to slow, the helical engagement of keyway 26 of shaft 22 within shaft receptacle 37 releases propeller toy 30 allowing it to move away from launching toy 10 as shown in FIG. 3. During the unwinding of main spring 120, spring anchor 123 is free to move upon main shaft 22 allowing spring 120 to fully unwind.

Once propeller toy 30 has been launched, toy 10 may once again be configured for propeller toy launch by releasing trigger 13 and snap-fitting an additional propeller toy upon main shaft 22 and forcing it into passage 26 of sleeve 21. Thereafter, winding collar 20 is again moved through rotational strokes using the above-described ratcheting mechanism to wind main spring 120 and again prepare toy 10 for launch of a propeller toy.

FIG. 4 sets forth a section view of toy 10 taken along section lines 4—4 in FIG. 2. FIG. 4 is provided to show the structure of the ratcheting mechanism operable to provide winding of main spring 120 (seen in FIG. 3). More specifically, toy 10 includes a winding collar 20 and ratchet collar 70 rotatably supported by a main shaft 22. Ratchet collar 70 further includes a generally planar wall 74 defining a plurality of circular apertures 71, 72 and 73 in an equally spaced arrangement about main shaft 22. A plurality of ratchet pawls 80, 82 and 84 define respective cylindrical posts 81, 83 and 85 which are received within apertures 71, 72 and 73 respectively to pivotally secure ratchet pawls 80, 82 and 84 upon wall 74 of ratchet collar 70. A cylindrical sleeve 89 is rotatably supported upon main shaft 22 and is coupled to ratchet pawls 80, 82 and 84 by a plurality of curved springs 86, 87 and 88 respectively. A ratchet barrel 110 which comprises a cylindrical portion of spring housing 100 (seen in FIG. 3) defines a plurality of angled ratchet teeth 94 through 99 and 112 through 115 supported upon the interior surface of ratchet barrel 110 in a generally equally spaced arrangement. Ratchet teeth 94 through 99 and 112 through 115 are nonsymmetrical providing sharp edges on their counterclockwise side and angled sloped edges on their clockwise faces. The action of springs 86 through 88 operates upon ratchet pawls 80, 82 and 84 to pivotal rotation of each ratchet pawl about its respective post in a counterclockwise direction as viewed in FIG. 4.

In operation as winding collar 20 is rotated in the winding direction indicated by arrow 107, the attachment between winding collar 20 and ratchet collar 70 causes ratchet collar 70 including wall 74 to correspondingly rotate in the direction indicated by arrow 107. As ratchet pawls 80, 82 and 84 are carried upon wall 74, the angled facets of the ratchet teeth within ratchet barrel 110 and the action of springs 86 through 88 allow the ratchet pawls to pivot and move past the ratchet teeth permitting winding collar 20 and ratchet collar 70 to rotate which as described above causes main spring 120 (seen in FIG. 3) to be wound. Conversely, however, when the user releases winding collar 20 and ratchet collar 70 is urged by main spring 120 (seen in FIG. 3) toward rotation in the unwinding direction indicated by arrow 108, ratchet pawls 80, 82 and 84 engage the sharp noninclined facets of the ratchet teeth within ratchet barrel 110. This engagement precludes continued rotation in the direction of arrow 108 of ratchet collar 70 and winding collar 20. Thus, the user is able to freely wind collar 20 and ratchet collar 70 in the direction indicated by arrow 107 to store energy within the main spring while unwinding is resisted by the engagement of ratchet pawls 80, 82 and 84. This ratcheting action facilitates moving winding collar 20 in a rapid series of back and forth rotational motion to quickly wind main spring 120 as described above.

What has been shown is a propeller launching toy having an improved winding and trigger release mechanism for launching a propeller toy. The propeller launching toy shown may be readily fabricated for the most part of relatively inexpensive molded plastic components. Additionally, the propeller launching toy of the present invention is able to conveniently store and carry additional propeller toys in an interesting and aesthetically pleasing arrangement.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A propeller launching toy comprising:

a housing;

a trigger movable supported by said housing;

a main shaft supported within said housing and having a forward end extending from said housing and interior end, said main shaft being both rotatably and slidably supported by said housing;

a main spring coupled to said main shaft to be wound when said main shaft is rotated in a first rotational direction and unwound when said main shaft is rotated in an opposite second rotational direction;

a propeller toy having a center portion engageable with said forward end of said main shaft and a plurality of radially extending propeller blades;

a winding collar rotatably supported upon said housing;

a ratchet collar coupled to and rotatable with said winding collar having a plurality of first engagement members;

a disk joined to said main shaft having a plurality of second engaging members; and a trigger spring coupled to said main shaft urging said mainshaft slidably toward a position in which said first and second engaging members engage;

ratchet means coupled to said ratchet collar preventing rotation of said ratchet collar in said second rotational direction; and release means responsive to movement of said trigger to overcome said urging of said trigger spring and moving said main shaft toward a position in which said first and second engaging members disengage thereby allowing said main spring to rotate said mainshaft and said propeller toy.

2. A propeller launching toy as set forth in claim 1 wherein said winding collar defines a cylindrical portion defining an interior passage and wherein said center portion of said propeller toy includes a cylindrical member received within said interior passage.

3. A propeller launching toy as set forth in claim 2 wherein said cylindrical member of said propeller toy defines a shaft receptacle and wherein said forward end of said main shaft defines a keyway receivable in and engaging said shaft receptacle.

4. A propeller launching toy as set forth in claim 3 wherein said cylindrical portion of said winding collar defines a rib formed within said interior passage and wherein said shaft receptacle defines a cooperating outwardly extending rib for snap-fit engagement between said shaft receptacle and said cylindrical portion.

5. A propeller launching toy as set forth in claim 4 wherein said release means includes an arm pivotally supported within said housing and having a first end contacting said trigger and a second end contacting said interior end of said main shaft.

6. A propeller launching toy as set forth in claim 5 wherein said housing includes a pair of generally cylindrical supports for receiving a pair of propeller toys in a nonoperative carrying attachment.

* * * * *